US008403310B2

(12) United States Patent
Wang et al.

(10) Patent No.: US 8,403,310 B2
(45) Date of Patent: Mar. 26, 2013

(54) APPARATUS FOR HOLDING A FLAT OBJECT

(75) Inventors: Kun-Jie Wang, Taichung (TW); Rong-Jin Liang, Taichung (TW); David Tsai, Taichung (TW)

(73) Assignee: King Shen Co., Ltd., Taichung (TW)

( * ) Notice: Subject to any disclaimer, the term of this patent is extended or adjusted under 35 U.S.C. 154(b) by 355 days.

(21) Appl. No.: 12/769,842

(22) Filed: Apr. 29, 2010

(65) Prior Publication Data

US 2011/0266731 A1 Nov. 3, 2011

(51) Int. Cl.

| | |
|---|---|
| ***B23Q 3/00*** | (2006.01) |
| ***B23Q 1/25*** | (2006.01) |
| ***B25B 1/00*** | (2006.01) |
| ***B25B 1/22*** | (2006.01) |

(52) U.S. Cl. ..... 269/17; 269/287; 269/55; 269/71; 269/76

(58) Field of Classification Search ..... 269/55, 269/59, 287, 66, 58, 62, 71, 17, 76, 100, 269/289 R; 248/323, 333, 327, 339
See application file for complete search history.

(56) References Cited

U.S. PATENT DOCUMENTS

| | | | | |
|---|---|---|---|---|
| 2,803,872 | A * | 8/1957 | Massa | 269/37 |
| 3,632,101 | A * | 1/1972 | Ross | 269/70 |
| 3,858,864 | A * | 1/1975 | Waldow | 269/17 |
| 4,029,308 | A * | 6/1977 | Mathers | 269/17 |
| 4,183,511 | A * | 1/1980 | Marek | 269/17 |
| 4,239,196 | A * | 12/1980 | Hanger | 269/17 |
| 4,932,639 | A * | 6/1990 | Fjellstrom | 269/17 |
| 6,490,906 | B1 * | 12/2002 | Bailey | 72/457 |
| 7,445,184 | B1 * | 11/2008 | Johnson | 269/45 |
| 7,663,565 | B2 * | 2/2010 | Son et al. | 248/183.1 |

* cited by examiner

*Primary Examiner* — Monica Carter
*Assistant Examiner* — Seahee Yoon

(57) ABSTRACT

An apparatus is disclosed for holding a flat object. The apparatus includes a post, a supporting mechanism movably connected to the post, a clamping mechanism pivotally connected to the post, and a linking element for linking the supporting mechanism and the clamping mechanism together. Thus, the flat object is clamped by the clamping mechanism clamps when the flat object is supported on the supporting mechanism.

12 Claims, 8 Drawing Sheets

APPARATUS FOR HOLDING A FLAT OBJECT

BACKGROUND OF INVENTION

1. Field of the Invention The present invention relates to an apparatus for holding a flat object.

2. Related Prior Art

The present invention is therefore intended to obviate or at least alleviate the problems encountered in prior art.

SUMMARY OF INVENTION

It is the primary objective of the present invention to provide an apparatus for firmly holding a flat object.

To achieve the foregoing objective, the apparatus includes a post, a supporting mechanism movably connected to the post, a clamping mechanism pivotally connected to the post, and a linking element for linking the supporting mechanism and the clamping mechanism together. Thus, the flat object is clamped by the clamping mechanism clamps when the flat object is supported on the supporting mechanism.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
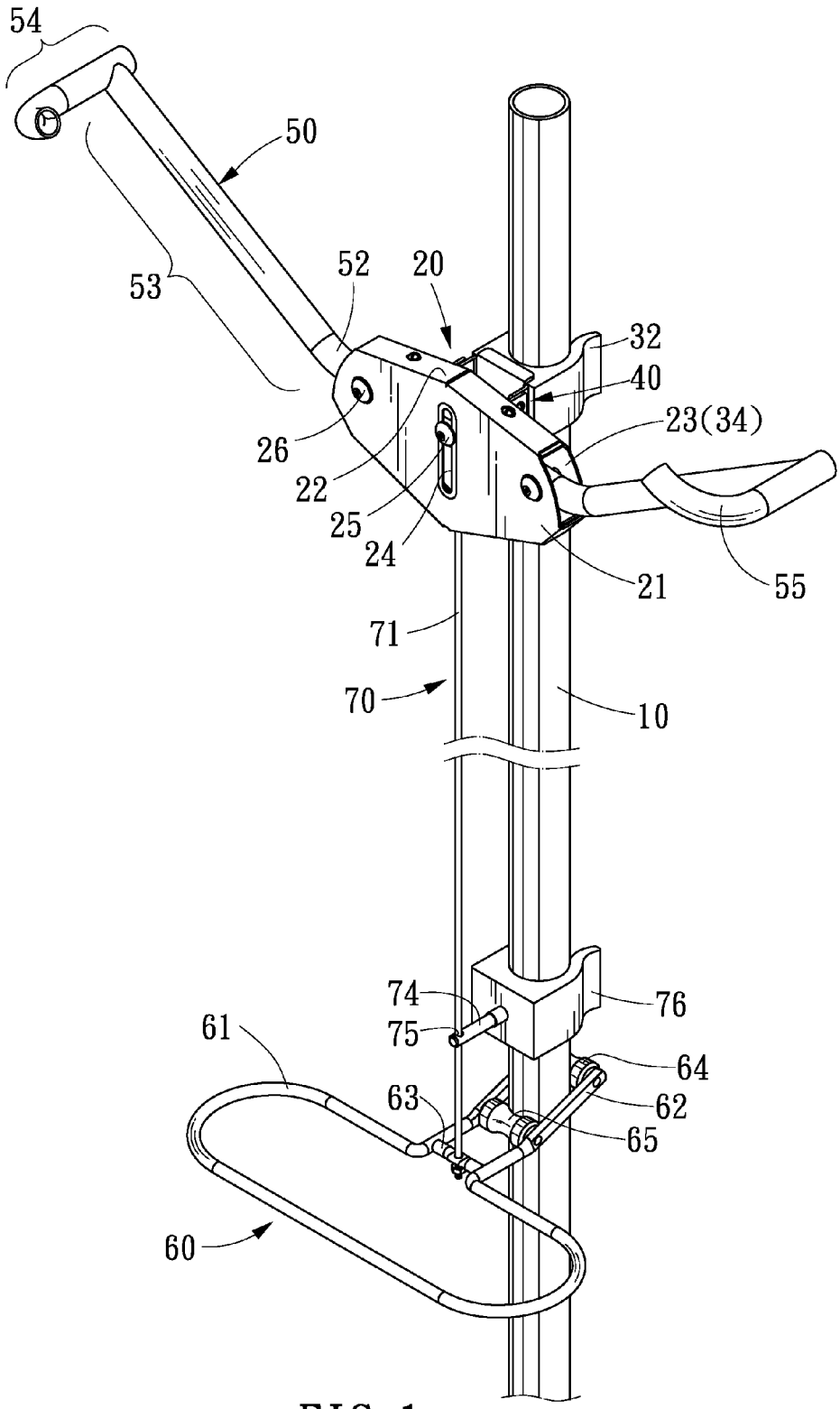
FIG. 1 is a perspective view of an apparatus for holding a flat object according to the first embodiment of the present invention.

Referring to FIG. 1, there is shown an apparatus for firmly holding a flat object according to a first embodiment of the present invention. The apparatus includes a post 10, a supporting mechanism 60 for supporting the flat object and a clamping mechanism for synchronously clamping the flat object.

Figure 2:
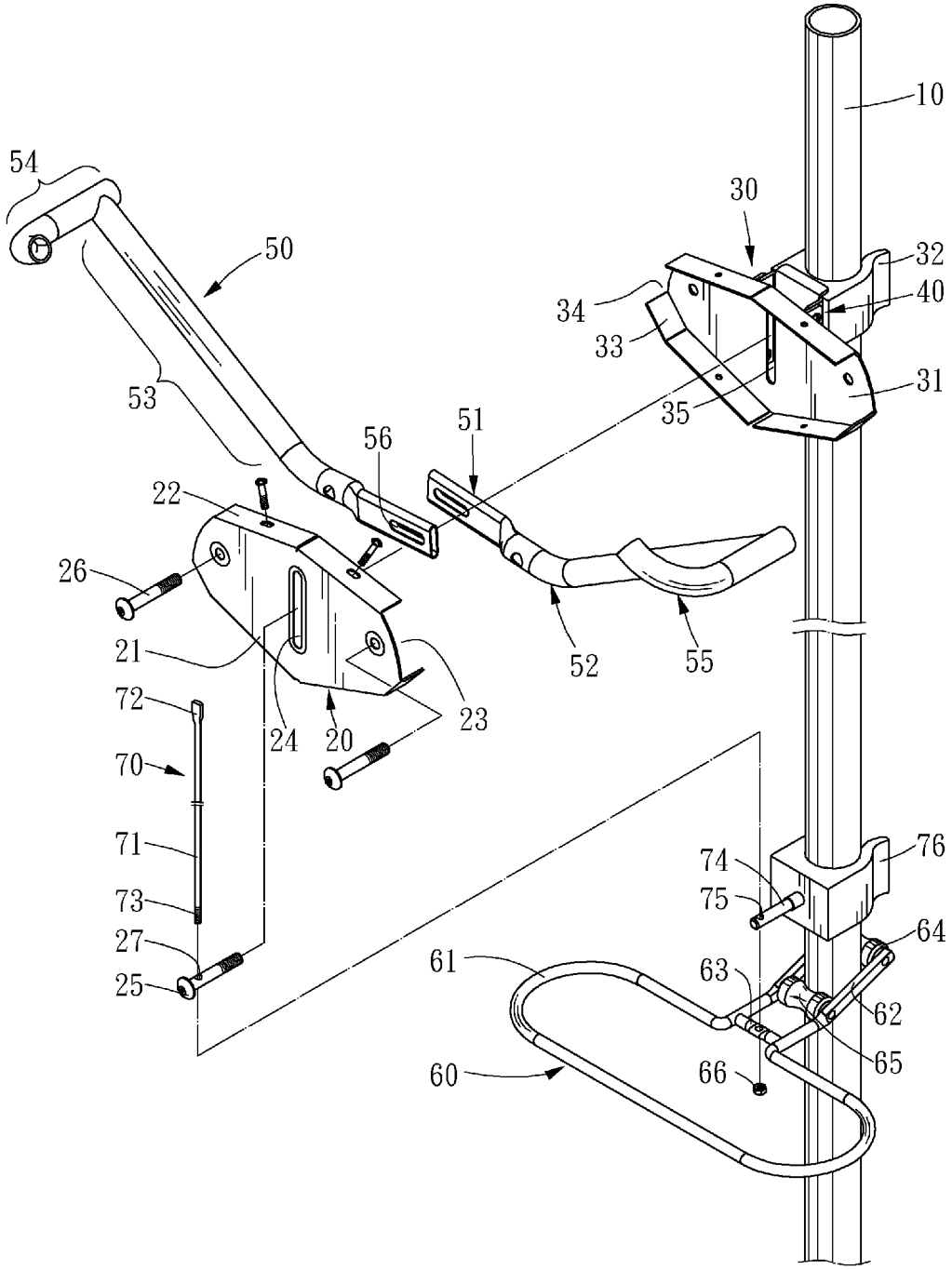
FIG. 2 is an exploded view of the apparatus shown in FIG. 1.
Figure 3:
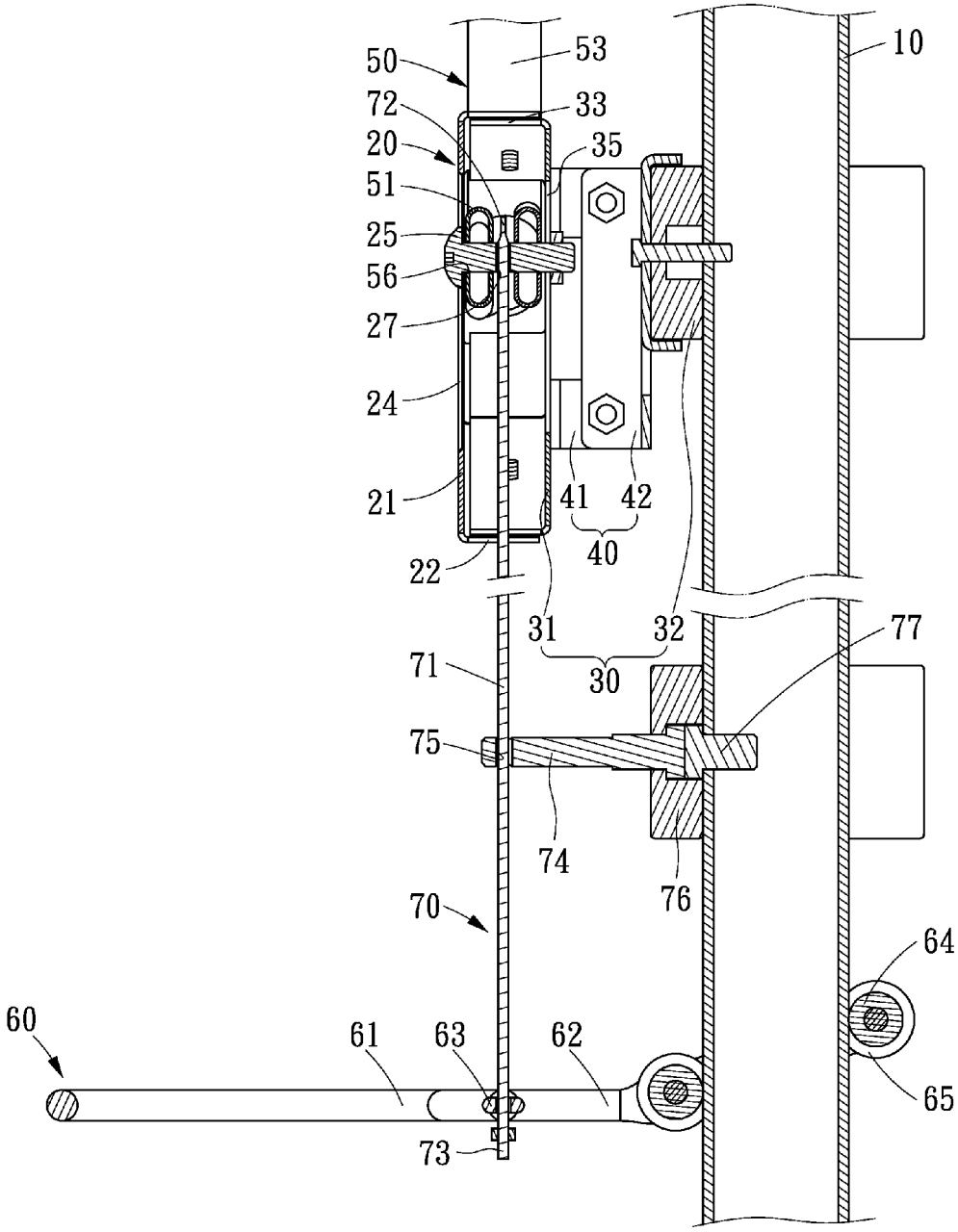
FIG. 3 is a cross-sectional view of the apparatus shown in FIG. 1.

Referring to FIGS. 2 and 3, the supporting mechanism 60 includes a ferrule 61, two longitudinal bars 62, a crossbar 63 and two rollers 64. The ferrule 61 and the longitudinal bars 62 are different portions of a single tube that is curved. Each of the longitudinal bars 62 is made with a flat portion. Each of the rollers 64 is supported on a pin that is driven through the flat portions of the longitudinal bars 62. The longitudinal bars 62 extend in parallel to each other. The rollers 64 extend in parallel to each other. Each of the rollers 64 includes a concave face 65 for contact with the post 10. The post 10 is located between the rollers 64. Thus, the supporting mechanism 60 is movable along the post 10. The crossbar 63 is connected to the longitudinal bars 62 by welding for example. An aperture is defined in the crossbar 63.

The clamping mechanism includes two jaws 50 and a connective unit for pivotally connecting the jaws 50 to the post 10. Each of the jaws 50 includes a flat portion 51, a bent portion 52, a connective portion 53, a contact portion 54 and a security portion 55. The flat portion 51 includes a slot 56 defined therein. The bent portion 52 includes an aperture defined therein. The weight and length of the connective portion 53 are much larger than the weight and length of the flat portion 51. The contact portion 54 is transversely connected to the connective portion 53 by welding for example. The security portion 55 extends transversely from the contact portion 54.

The connective unit includes a front cover 20, a rear cover 30, a clip 32 and a joint 40. The front cover 20 includes a panel 21 and strips 22. The panel 21 includes a slot 24 and two apertures defined therein. The slot 24 is located between the apertures of the panel 21. The strips 22 transversely extend from the panel 21, leaving two openings 23 between them.

The rear cover 30 is made corresponding to the front cover 20. Similarly, the rear cover 30 includes a panel 31 and strips 33. The panel 31 includes a slot 35 and two apertures defined therein. The slot 35 is located between the apertures of the panel 31. The strips 33 transversely extend from the panel 31, leaving two openings 34 between them.

The clip 32 includes a middle portion between two jaws. The post 10 is located between the jaws of the clip 32.

The joint 40 includes a U-shaped element 42 between two L-shaped elements 41. The U-shaped element 42 includes a middle portion between two lateral portions. A screw is driven in the post 10 through the middle portion of the U-shaped element 42 and the middle portion of the clip 32. Thus, the joint 40 and the clip 32 are positioned on the post 10. Each of the L-shaped elements 41 includes a portion connected to a related one of the lateral portions of the U-shaped element 42 by or screws and nuts for example and another portion connected to the panel 31 of the rear cover 30 by welding for example. Thus, the rear cover 30 is firmly connected to joint 40. The rear cover 30 is positioned on the post 10 by the joint 40 and the clip 32.

The flat portion 51 and the bent portion 52 of each of the jaws 50 are located in a shell made of the covers 20 and 30. The connective portion 53 of each of the jaws 50 extends to the exterior of the shell through a related one of the openings 23 and a related one of the openings 34. A screw 26 is inserted through a related one of the apertures of the panel 21, the aperture of the bent portion 52 of a related one of the jaws 50, and a related one of the apertures of the panel 31 and engaged with nut. Thus, the jaws 50 are pivotally connected to the post 10. The strips 22 cover the strips 33. Screws are driven through the strips 22 and 33. Thus, the front cover 20 is firmly connected to the rear cover 30.

There is provided a linking element 70 for connecting the jaws 50 to the cross bar 63. The linking element 70 includes a rod 71, a flat head 72 at an end of the rod 71, and a screw 73 at an opposite end of the rod 71. The linking element 70 is inserted through an aperture 27 defined in a pin 25 driven through the slot 24 of the panel 21, the slots 56 of the jaws 50 and the slot 35 of the panel 31. The flat head 72 keeps the linking element 70 on the pin 25. The linking element 70 is located between the flat portions 51 of the jaws 50 because the bent portion 52 of one of the jaws 50 is biased towards the front cover 20 while the bent portion 52 of the other jaw 50 is biased towards the rear cover 30. The screw 73 is inserted through the aperture defined in the crossbar 63 before it is engaged with a nut 66.

There is provided a guiding element 74 attached to another clip 76. The guiding element 74 includes an aperture 75 for receiving the rod 71. Thus, the rod 71 is guided by the guiding element 74. The clip 76 includes a middle portion between two jaws. The middle portion of the clip 76 includes an aperture for receiving a screw 77 driven in the post 10. The screw 77 prevents the clip 76 from moving along the post 10.

Figure 4:
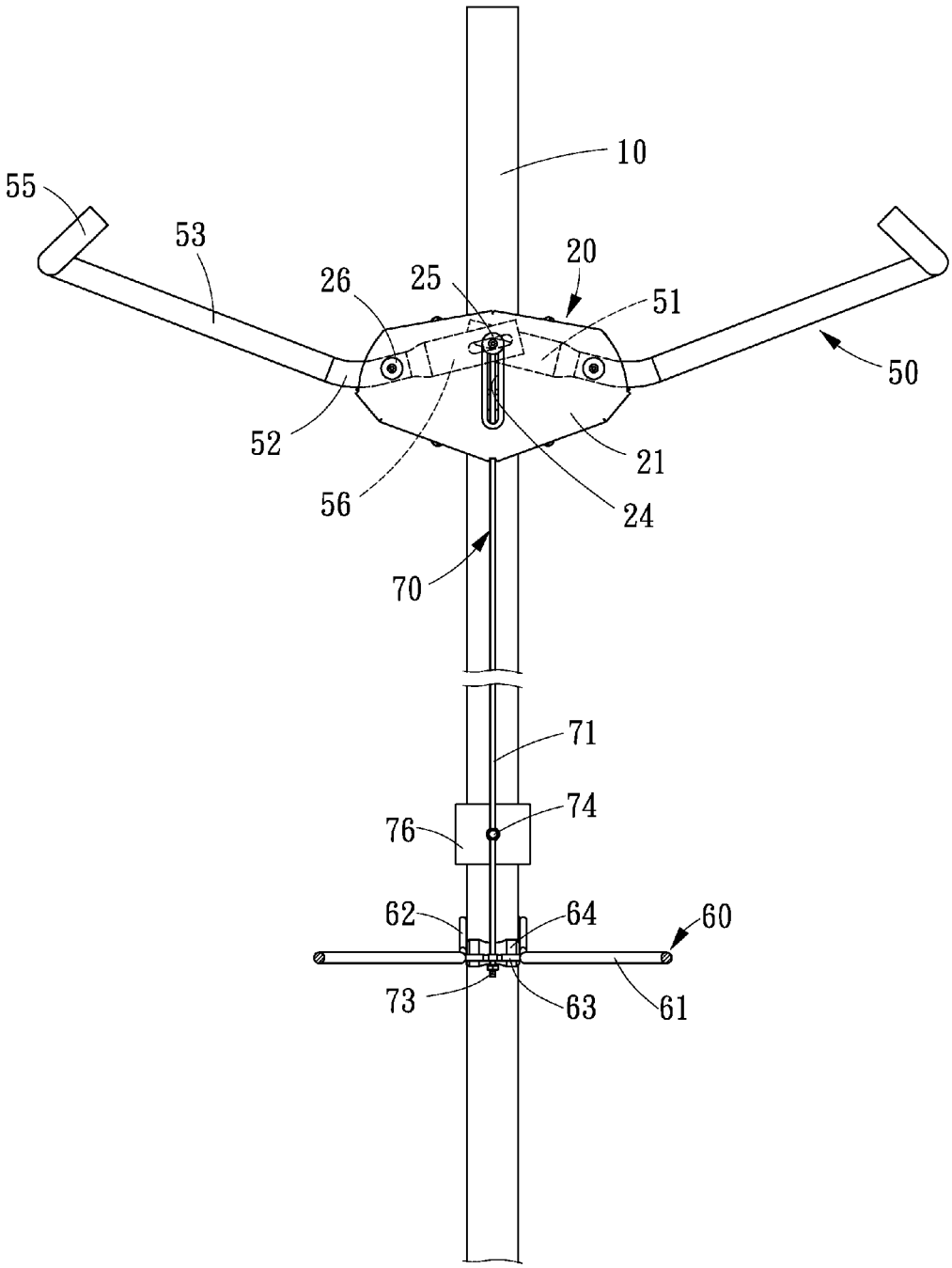
FIG. 4 is a front view of the apparatus shown in FIG. 1.

Referring to FIG. 4, the flat portions 51 of the jaws 50 are much shorter and lighter than the connective portions 53 of the jaws 50. Moreover, each of the jaws 50 is pivotally connected to the panel 31 at the bent portion 52. Hence, because of gravity, the flat portions 51 of the jaws 50 are lifted while the connective portions 53 of the jaws 50 are lowered. That is, the jaws 50 are opened. Through the linking element 70, the supporting mechanism 60 is lifted, too.

Figure 5:
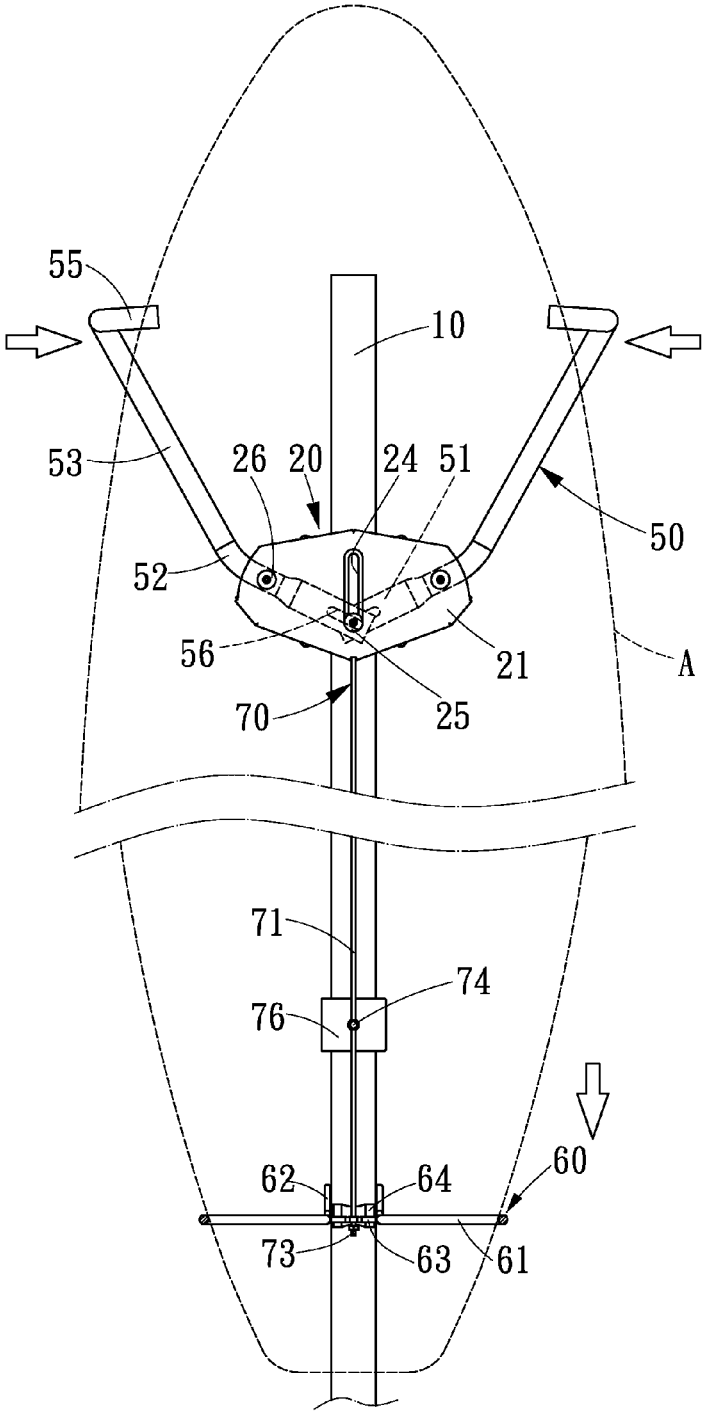
FIG. 5 is a front view of a surfboard firmly held on the apparatus shown in FIG. 1.
Figure 6:
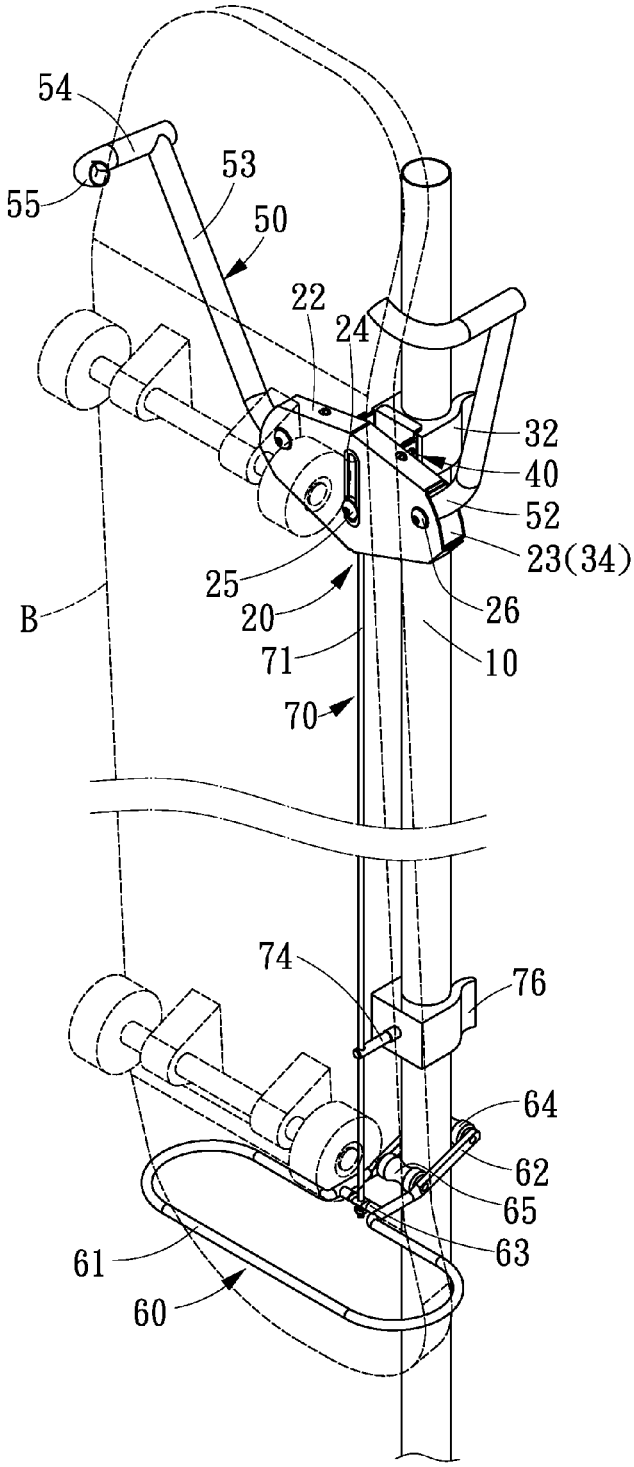
FIG. 6 is a front view of a skateboard firmly held on the apparatus shown in FIG. 1.
Figure 7:
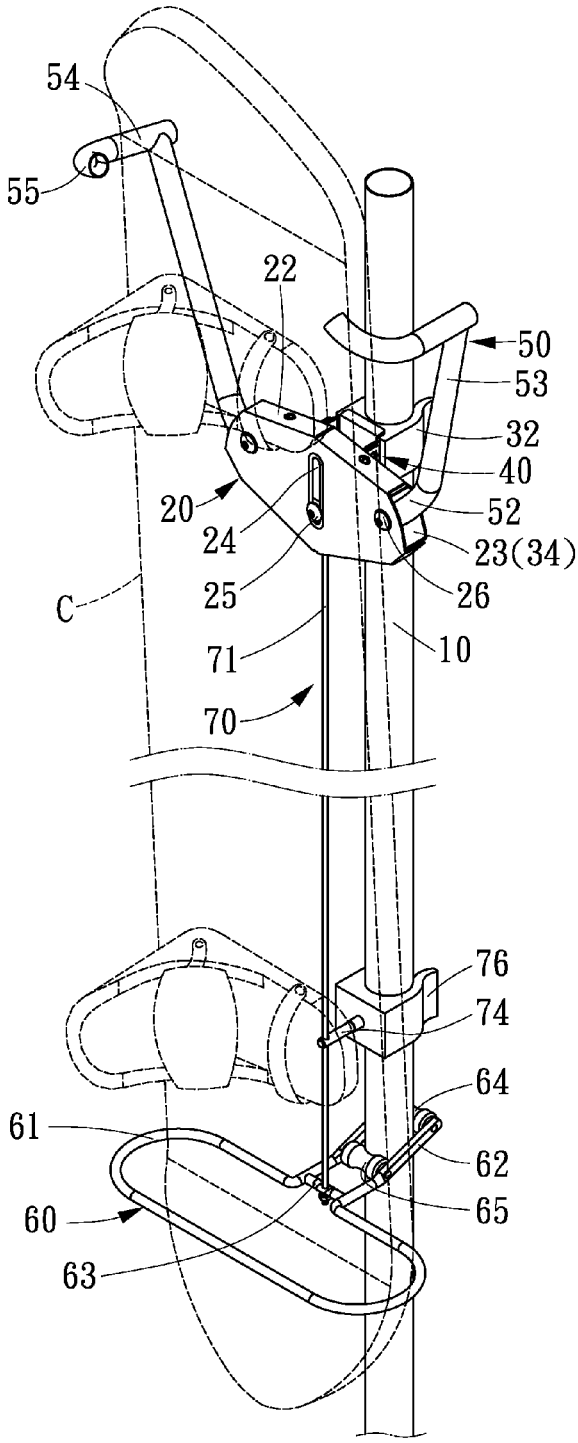
FIG. 7 is a front view of a snowboard firmly held on the apparatus shown in FIG. 1.

Referring to FIG. 5, a surfboard A is firmly held on the apparatus. A lower portion of the surfboard A is circled in and supported on the ferrule 61. The supporting mechanism 60 is lowered. By the linking element 70, the flat portions 51 of the jaws 50 are lowered while the connective portions 53 of the jaws 50 are lifted. That is, the jaws 50 are closed. Accordingly, the contact portions 54 of the jaws 50 clamp the surfboard A. The surfboard A is retained between the post 10 and the security portions 55 of the jaws 50. Referring to FIG. 6, a skateboard B is firmly held on the apparatus. Referring to FIG. 7, a snowboard C is firmly held on the apparatus.

Figure 8:
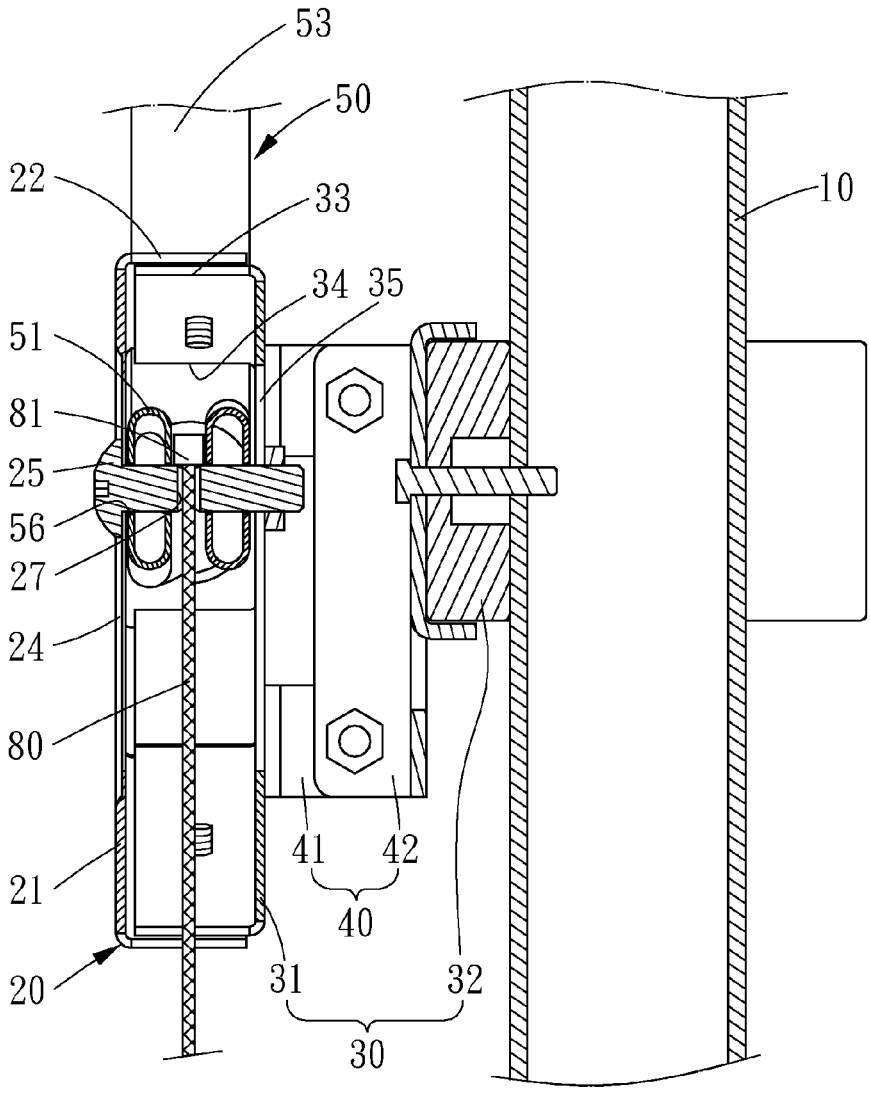
FIG. 8 is a cross-sectional view of an apparatus for holding a flat object according to the second embodiment of the present invention.

Referring to FIG. 8, there is shown an apparatus according to a second embodiment of the present invention. The second embodiment is like the first embodiment except including a linking element 80 instead of the linking element 70. The linking element 80 is a cable. An upper end of the linking element 80 is inserted through the aperture 27 of the pin 25 before it is connected to a block 81 abutted against the pin 25. Although not shown, lower end of the linking element 80 is inserted through the aperture of the crossbar 63 before it is connected to another block abutted against the crossbar 63. The block abutted against the crossbar 63 is preferably identical to the block 81 abutted against the in 25.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. An apparatus for holding a flat object, the apparatus including:

a post;

a supporting mechanism movably connected to the post, wherein the supporting mechanism includes a ferrule, two longitudinal bars extending from the ferrule, and a crossbar extending between the longitudinal bars;

a shell connected to the post;

two jaws each made with a slot and partially inserted in and pivotally connected to the shell;

a pin inserted through the shell and the slots of the jaws; and a linking element for connecting the crossbar to the pin so that the flat object is clamped by the jaws when the flat object is supported on the supporting mechanism.

2. The apparatus according to claim 1, wherein the supporting mechanism includes two rollers located between the longitudinal bars and in contact with the post.

3. The apparatus according to claim 2, wherein each of the rollers includes a concave face in contact with the post.

4. The apparatus according to claim 1, wherein the linking element includes:

a rod inserted through the crossbar and the pin;

a screw formed at a lower end of the rod and engaged with a nut abutted against the crossbar; and a flat head formed at an upper end of the rod and abutted against the pin.

5. The apparatus according to claim 1, wherein the linking element includes:

a rope for interconnecting the crossbar and the pin.

6. The apparatus according to claim 1, further including a guiding element connected to the post and formed with an aperture through which the linking element is inserted.

7. The apparatus according to claim 6, further including a clip for clipping the post, wherein the guiding element is connected to the clip.

8. The apparatus according to claim 1, wherein the shell includes a rear cover connected to the post and a front cover connected to the rear cover.

9. The apparatus according to claim 8, wherein the rear cover includes two openings defined therein, wherein the front cover includes two openings defined therein, wherein the jaws are inserted through the openings of the front and rear covers.

10. The apparatus according to claim 8, further including:

a clip for clipping the post; and a joint for connecting the rear cover to the clip.

11. The apparatus according to claim 10, wherein the joint includes:

a U-shaped element connected to the post; and two L-shaped elements each including a portion connected to U-shaped element and another portion connected to a lateral portion of the rear cover.

12. An apparatus for holding a flat object, the apparatus including:

a post;

a supporting mechanism movably connected to the post;

a clip for clipping the post;

a shell including a rear cover and a front cover attached to the rear cover;

a joint including a U-shaped element connected to the clip and two L-shaped elements each including a portion connected to the U-shaped element and another portion connected to a lateral portion of the rear cover;

two jaws partially inserted in and pivotally connected to the shell; and a linking element for connecting the supporting mechanism to the jaws so that the flat object is clamped by the jaws when the flat object is supported on the supporting mechanism.

* * * * *